United States Patent [19]

Henderson et al.

[11] 3,974,817

[45] Aug. 17, 1976

[54] BREAKERLESS IGNITION CONTROL SYSTEM

[75] Inventors: Robert M. Henderson, Williams Bay; Richard Zechlin, Beloit, both of Wis.

[73] Assignee: Colt Industries Operating Corporation, New York, N.Y.

[22] Filed: July 18, 1974

[21] Appl. No.: 489,552

[52] U.S. Cl. ..... 123/149 C; 123/146.5 A; 123/149 D; 310/153

[51] Int. Cl.[2] ..... F02P 1/02; F02P 5/02

[58] Field of Search ..... 123/149 C, 149 D, 148 E, 123/146.5 A, 149 R; 310/153, 156, 70 R, 70 A

[56] References Cited

UNITED STATES PATENTS

| | | | |
|---|---|---|---|
| 1,508,262 | 9/1924 | Young | 310/153 X |
| 3,663,850 | 5/1972 | Phelon | 310/153 |
| 3,678,913 | 7/1972 | Zimmermann et al. | 123/149 D |
| 3,741,185 | 6/1973 | Swift et al. | 123/149 D X |
| 3,799,137 | 3/1974 | Reddy | 123/149 D X |
| 3,828,754 | 8/1974 | Carlsson | 123/149 D |
| 3,886,916 | 6/1975 | Henderson | 123/148 E X |

FOREIGN PATENTS OR APPLICATIONS

| | | | |
|---|---|---|---|
| 246,491 | 3/1963 | Australia | 310/153 |

*Primary Examiner*—Charles J. Myhre
*Assistant Examiner*—Tony M. Argenbright
*Attorney, Agent, or Firm*—Leo J. Aubel

[57] ABSTRACT

An ignition system for use with spark ignited engines wherein the ignition system is compact and mounted beneath the associated flywheel. The ignition system includes a manually actuated timing ring for manually advancing the firing point, and includes a rotor essentially in the form of a spiral having a discrete discontinuity on its periphery for providing enhanced safety features.

7 Claims, 7 Drawing Figures

Fig. 1
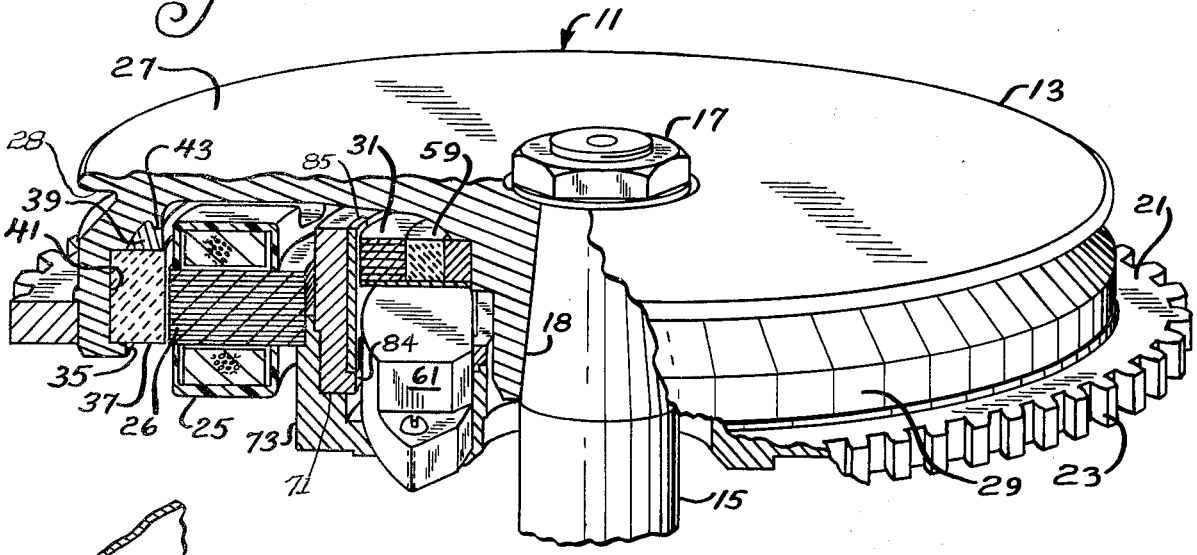
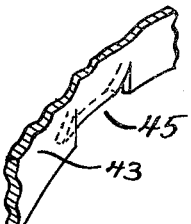
Fig. 1a
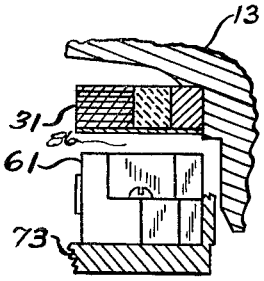
Fig. 1b
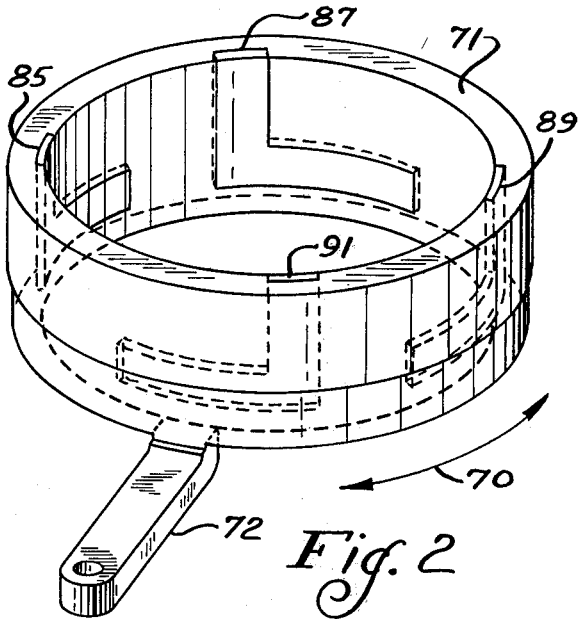
Fig. 2
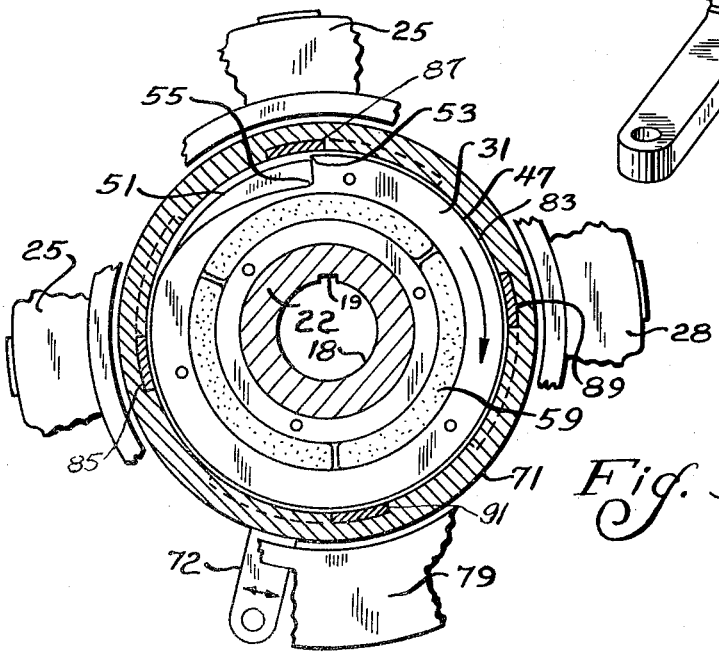
Fig. 3

BREAKERLESS IGNITION CONTROL SYSTEM

BACKGROUND OF THE INVENTION

This invention relates to an ignition system for spark ignited engines. This application is related to U.S. Pat. No. 3,799,137 entitled "Pulser Rotor For Ignition Systems", U.S. application Ser. No. 389,680 filed Aug. 20, 1973 now U.S. Pat. No. 3,886,916 entitled "Timing Mechanism For Breakerless Ignition Systems", and U.S. application Ser. No. 489,410 filed July 14, 1974 entitled "Electronic Ignition System With Combined Output From Multiple Coils", all of which are assigned to the same assignee as the present invention.

A large number of ignition systems are well known in the art for all types of spark ignited systems. The subject invention is intended as a specific improvement over the prior art and is directed to an ignition system wherein the components of the ignition system are of compact construction and arranged and positioned to be mounted beneath an associated flywheel.

Various breakerless ignition systems have been disclosed in the prior art wherein mechanical breakers are replaced by solid state electronic switches controlled by a trigger signal. Breakerless systems are generally more reliable than mechanical systems and are less subject to wear and deterioration.

Some prior art ignition systems also include an adjustable timing mechanism which rotates the spark initiation or trigger mechanism means relative to the piston and crank shaft position to change the advance characteristics of the associated engine. In such systems, the wires connecting the rotating trigger mechanism to the stationary portions of the engine are thus continually flexed, and such continual movement and flexing of the wires may cause breaking of the wires of the wire insulation and thus, malfunctioning of the ignition system. Accordingly, it has been found desirable to prevent movement or flexing of the wires to prevent eventual damage and breakage.

The present structure provides a simplified and adjustable timing ring mechanism including pole pieces mounted in the movable ring, the ring mechanism providing controlled air gap and flux path length between each pole piece mounted in the timing ring and the associated triggering coil core; and the ring mechanism providing a means of mechanically adjusting the timing of the engine without flexing the associated ignition wires.

In certain present engines, there is a safety problem in that the engine may undesirably operate in a relatively reverse direction. Various efforts have heretofore been made to provide an ignition system structure which will inhibit the engine flywheel from rotating in the reverse direction. The present invention provides a simplified and improved structure for the foregoing purpose including a rotor assembly which develops an output for firing the engine when the rotor is rotated in the desired direction of rotation, and an output of insufficient amplitude to fire the engine when the rotor is rotated in the opposite direction. The inventive rotor, in conjunction with the associated electronic circuitry, inhibits rotation of the engine in a reverse direction.

The foregoing and other objects, features and advantages of the present invention will be apparent from the following more particular description as illustrated in the accompanying drawings wherein:

DESCRIPTION OF THE DRAWINGS

FIG. 1 is an isometric view partially in cross section of the inventive system including a flywheel mounted on an associated engine shaft and showing the ignition system components mounted beneath the flywheel;

FIG. 1*a* is a view partially in cross section indicating a detented or pushed-in portion of the downwardly extending flange member on the flywheel to anchor or securely retain the ring of magnets;

FIG. 1*b* is a view partially in cross section to show the clearance gap between the trigger coils and the rotor assembly;

FIG. 2 is an isometric view of the timing ring of FIG. 1 showing the pole pieces mounted therein;

FIG. 3 is a top or plan view showing the relation of the timing ring and the rotor assembly in reference to the associated permanent magnets and pole pieces;

DESCRIPTION OF THE INVENTION

Figure 4:
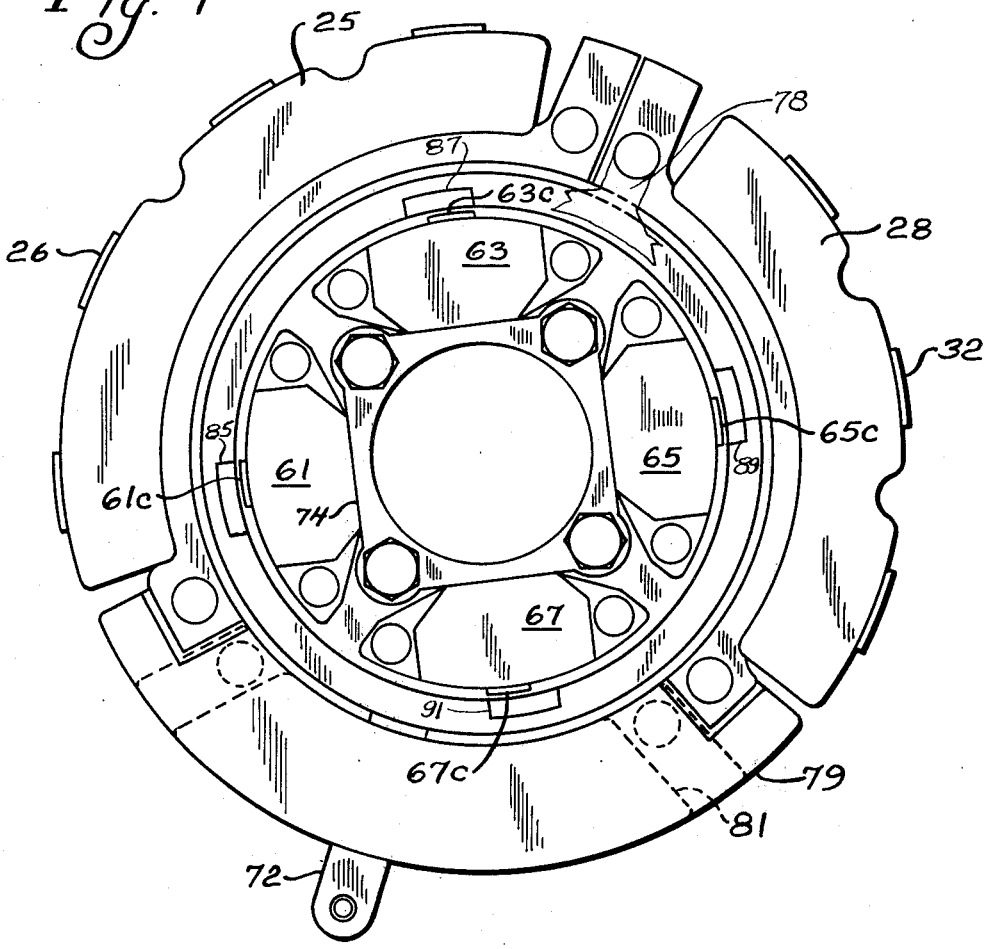
FIG. 4 is a top view of selected components of the ignition system showing the relative mounting orientation; and, FIG. 5 is a view of the flywheel, in an inverted orientation relative to FIG. 1, to show the positioning of the rotor assembly and the associated ring of magnets on the flywheel.

FIG. 1 shows the ignition system 11 of the invention including a flywheel 13 having a central aperture 18. Flywheel 13 may be of forged steel and is mounted for rotation on the engine shaft 15 secured by bolt means 17.

Figure 5:
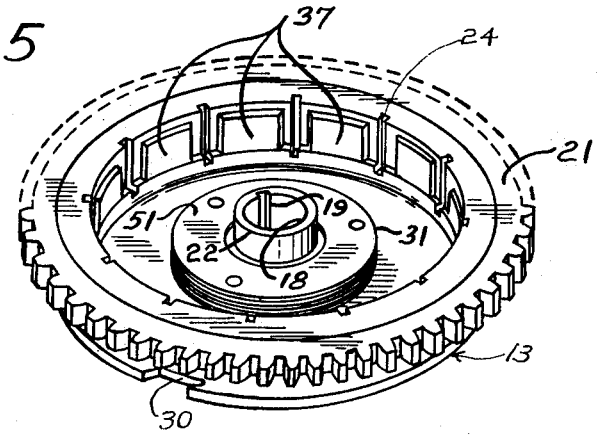

Flywheel 13 is shown in a relatively inverted position in FIG. 5 to better show the components on the flywheel. Referring to FIG. 1, the flywheel 13 is in the form of an inverted cup, or a capped foreshortened cylinder with a flat upper or capped surface 27 and downwardly extending side walls 29 including an open bottom. A ring 21 with gears 23 on its periphery is heat shrunk onto flywheel 13.

Affixed to the flywheel is a rotor assembly 31, best shown in FIGS. 3 and 5. The configuration of rotor assembly 31 will be explained in more detail hereinbelow. A ring of magnets 37 is mounted on the inner surface 36 of the side walls 29 of the flywheel 13. The magnets are positioned in a circumferential recess 41 formed on the surface 35. Te ring of magnets are then affixed or retained in selectively spaced relation in recess 41 by disposing a retaining filler or retaining seal 39 such as zinc, aluminum or plastic in a portion of recess 41 defined by a downwardly extending flange 43, and against, between and around the magnets 37 to hold the magnets in position.

To provide a firm anchor or stop for the ring of magnets, the downwardly extending flange 43 of flywheel is bent outwardly at spaced points along the periphery of the flywheel as at 45, see FIG. 1a, to thereby securely engage retaining seal 39 and the ring of magnets 37.

Referring to FIGS. 1 and 5, the rotor assembly 31 is mounted on flywheel 13. The rotor assembly 31 is formed of a magnetic material and as stated, the outer surface or periphery 47 of the rotor assembly 31 is formed preferably as a convolution of a spiral, see FIG. 3; however, for convenience in manufacturing, the periphery of the rotor may not follow the exact mathematical configuration of a spiral. The periphery 47 of the rotor 31 includes a peak or maximum diameter portion 53 and a minimum diameter portion 55 which are joined by radially extending surface.

In FIG. 5, the rotor assembly 31 is shown in its inverted position which includes a thin support member 51 which is circular in shape. The electrical functioning portion of the rotor assembly 31, is however, the spirally shaped periphery 47.

Rotor assembly 31 includes magnets 59, formed as portions of a circle, mounted in spaced relation to provide magnetic fields having lines of flux extending outward through the rotor 31, as is known.

The rotor assembly 31 is mounted within the periphery of a timing ring 71, which may be an aluminum casting. An air gap is formed at 83 between the inner surface of the ring and the outer surface of the pulser rotor 31 and has a discrete discontinuity at the point at which the maximum diameter 53 decreases abruptly to the minimum diameter point 55.

Timing ring 71 includes magnetic pole pieces, four such L-shaped pole pieces numbered, 85, 87, 89 and 91, being shown in the embodiment of FIGS. 2 and 3. The pole pieces 85, 87, 89 and 91 are embedded in spaced relation in associated recesses formed in the inner surface of timing ring 71. A portion of the L-shaped pole piece extends substantially vertically (see FIGS. 2 and 3) and the other portion of the L-shaped extends substantially horizontally on the periphery of the timing ring 71.

A retainer ring 78 which is of resilient material or which can include resilient fingers (a portion of the ring only being shown in FIG. 4) is affixed over timing ring 71. The ring 78, or portion thereof, press against timing ring 71 to prevent vibration of the timing ring and to generally hold the timing ring 71 in the position to which it is adjusted.

The configuration of the rotor assembly 31 provides the advantage that if the rotor assembly 31 is rotated in a first or clockwise direction in FIG. 3, a suitable unidirectional positive polarity triggering pulse is provided for energizing the associated spark plug. However, should the rotor 31 be rotated in a relatively reverse direction, the pulses developed will be of minimal amplitude in the positive polarity and will be of insufficient amplitude to energize the associated spark plugs.

Trigger coils 61, 63, 65 and 67 and the associated radially extending cores 61C, 63C, 65C and 67C comprise a portion of a spider member 74 (see FIGS. 1 and 4) and are supported by brackets 73 affixed to the engine mounts and positioned relatively below the rotor assembly 31. Timing ring 71 is supported on bearing support 73 and an air gap 84 is provided for mechanical clearance between the trigger coils 61, 63, 65 and 67 and the timing ring 71. A mechanical clearance gap 86 is also formed between rotor assembly 31 and the trigger cores 61, 63, 65 and 67, see FIG. 1*b*.

The stator assembly 25 including the power coils and the associated core is stationarily mounted on bearing support 73. The stator assembly 25 interacts with the rotating magnets 41 on the flywheel 13 to generate the energy to charge the ignition system capacitors. As explained in the above cited application, Ser. No. 489,410 the stator asembly 25 is effective to charge the capacitors in the capacitor assembly 79 which are then selectively discharged through known solid state switching circuitry into the associated ignition coil. As also explained in the aforesaid application, the stator assembly 28, including alternator coils and the associated core, interact with rotating magnets 41 to controllably charge the associated battery, not shown, through a rectifier assembly 81.

Timing ring 71 includes a throttle linkage 72 which is connected to a manually adjustable handle or knob (not shown) to permit movable, rotatable adjustment of timing ring 71.

In the embodiment shown, the timing ring 71 is movable as indicated by the arrow 70 (FIG. 2) about 30 degrees; but regardless of the position of the ring, a peripherally extending portion of each pole piece 85, 87, 89 and 91 is always adjacent to the core of the associated trigger coil. However, note that the rotor assembly 31 is positioned to rotate adjacent the vertical portion of the pole pieces 85, 87, 89 and 91. Thus, the relative position at which the maximum diameter point 53 of the rotor assembly 31 passes adjacent to axially extending portion of each pole piece is dependent on the manual setting or positioning of the timing ring 71, and the point at which the firing pulse is obtained depends on the setting of the timing ring 71.

The trigger coils 61, 63, 67 and 69 are electrically coupled to a suitable electronic circuit as discussed in the above cited application Ser. No. 489,410 entitled "Electronic Ignition System With Combined Output From Multiple Coils" and thence through an ignition coil to fire the associated spark plug.

Note importantly, that timing ring 71 can be moved to adjust the timing mechanically independent of the trigger coils 61, 63 65 and 67 and independently of any of the other components of the system. No electrical wires are attached to ring 71, and accordingly, the wiring of the system is not disturbed, stressed or flexed by movement of ring 71.

Also, the flywheel 13 provides a protective cover and shield to protect the compactly mounted components of the ignition system component from the environment as well as from mechanical damage. The ignition system components are mounted in circular configuration around the axis of the flywheel 13 and substantially adjacent a plane perpendicular to the axis to thereby provide a compact assembly which is of a much reduced height dimension.

Referring to FIG. 5, the inner surface of flywheel 13 includes vertically oriented slots 24 which tend to create air movement when the is rotating for cooling the ignition system components. Also, as is known, the side walls 29 of the flywheel 13 include a groove 28 for accomodating a starting line or rope and a slot 30 is formed on the periphery of surface 27 for engaging the knot on the end of the starting lines.

Note, of course, that the particular orientation of the flywheel 13 shown in FIG. 1 is not limiting but it can also be mounted to have its axis in a horizontal or angled orientation.

While the invention has been particularly shown and described with reference to preferred embodiments thereof, it will be understood by those skilled in the art that various changes in form and details may be made without departing from the spirit and scope of the invention.

What is claimed is:

1. An ignition system for controllably providing energy to fire the spark plugs of an associated engine, said system comprising, in combination a flywheel comprising a capped cylinder with axially depending walls, said flywheel being mountable on a shaft operable by the engine, magnets mounted along the inner surface of the cylindrical walls of the flywheel, stator assemblies and electronic component assemblies formed as portions of a circle positioned around the axis of the flywheel, substantially in circular configuration and substantially adjacent a plane, perpendicular to the axis said stator assembly including, a timing ring having pole pieces formed thereon, said ring being adjustably mounted within the periphery of said flywheel, a rotor assembly including magnet means mounted centrally on said flywheel and rotatable therewith, said rotor assembly positioned within the periphery of said timing ring and forming an air gap therebetween, and a stationary triggering coil assembly mounted within the periphery of said timing ring, said rotor assembly interacting with the pole pieces of said timing ring and said trigger coils to provide a trigger pulse for the associated engine spark plugs whereby the foregoing assemblies and said ring mounted within the walls of the flywheel adjacent the capped portion to thereby obtain a compact ignition system which is protected and shielded by said flywheel.

2. An apparatus as in claim 1 wherein said stator and electronic component assemblies comprise a storage capacitor assembly formed as a portion of a circle and effective to store energy to fire the associated spark plugs, a first stator assembly formed as a portion of a circle and comprising power coils and cores interacting with said magnets when the flywheel rotates to develop formed for charging an associated battery, and a rectifier assembly forned as a portion of a circle and effective to rectify the output from said coils.

3. Apparatus as in claim 1 wherein said rotor assembly and a portion of said trigger coil are mounted within the periphery of said timing ring.

4. Apparatus as in claim 1 wherein said ring of permanent magnets is positioned in the inner surface of the walls of said cylinder to magnetically interact with said stator assembly.

5. Apparatus as in claim 4 wherein the wall of the flywheel includes a peripheral recess on its inner surface for receiving the ring of magnets, said recess including a flange means depending axially adjacent said recess, said flange means being detented at spaced peripheral points for providing anchors or stops for the filler material to prevent slippage of the ring of magnets upon rotation of the flywheel.

6. Apparatus as in claim 1 wherein the stationary stator assembly and the trigger coils are connected to electrical wiring, said timing ring is not connected to any electrical wiring, movement of the timing ring being mechanically independent of the trigger coils whereby no electrical wires are disturbed, flexed or stressed by movement of the ring.

7. Apparatus as in claim 1 wherein said timing ring is mounted between said rotor assembly, said first and second stator assemblies and between said trigger coils and said stator assemblies whereby said timing ring is movable to change the timing of the engine without affecting the function of said magnets and said stator assemblies.

* * * * *

UNITED STATES PATENT OFFICE
CERTIFICATE OF CORRECTION

PATENT NO. : 3,974,817

DATED : August 17, 1976

INVENTOR(S) : Robert M. Henderson and Richard Zechlin

It is certified that error appears in the above-identified patent and that said Letters Patent are hereby corrected as shown below:

Col. 1, line 36, after "wires" second occurence --or-- should be inserted.

Col. 2, line 48, "Te" should be --The-- .

Col. 3, line 26, "L-shaped" should be --L-shape--.

Col. 5, line 28, "formed" should be --energy--.

Col. 5, line 29, "forned" should be --formed--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*